US005613859A

United States Patent [19]

Bellantoni et al.

[11] Patent Number: 5,613,859

[45] Date of Patent: Mar. 25, 1997

[54] CONNECTOR ASEMBLY FOR DETACHABLY CONNECTING A PRINTED WIRING BOARD TO A COAXIAL TRANSMISSION LINES CONNECTOR

[75] Inventors: John V. Bellantoni, Redwood City; John S. Tobias, Sunnyvale, both of Calif.

[73] Assignee: Watkins-Johnson Company, Palo Alto, Calif.

[21] Appl. No.: 563,299

[22] Filed: Nov. 28, 1995

[51] Int. Cl.[6] ..... H01R 9/09

[52] U.S. Cl. ..... 439/63; 333/260

[58] Field of Search ..... 333/260, 33; 439/63, 439/581

[56] References Cited

U.S. PATENT DOCUMENTS

| | | | |
|---|---|---|---|
| 3,292,117 | 12/1966 | Bryant et al. | 333/260 |
| 4,603,926 | 8/1986 | Nesbit et al. | 439/581 |
| 4,656,441 | 4/1987 | Takahashi et al. | 333/260 |
| 4,816,791 | 3/1989 | Carnahan et al. | 333/260 |
| 4,995,815 | 2/1991 | Buchanan et al. | 333/260 |
| 5,334,050 | 8/1994 | Andrews | 439/581 |

*Primary Examiner*—Neil Abrams
*Assistant Examiner*—Barry Matthew L. Standig
*Attorney, Agent, or Firm*—Flehr, Hohbach, Test, Albritton & Herbert

[57] ABSTRACT

A connector assembly for detachably connecting a coaxial transmission line to a micro-strip lead formed on a printed wiring board is disclosed.

4 Claims, 3 Drawing Sheets

CONNECTOR ASEMBLY FOR DETACHABLY CONNECTING A PRINTED WIRING BOARD TO A COAXIAL TRANSMISSION LINES CONNECTOR

FIELD OF THE INVENTION

This invention relates generally to microwave and other high-frequency communication systems, and more particularly to a connector assembly for detachably connecting coaxial transmission lines to printed wiring board circuits housed in a metallic enclosure.

BACKGROUND OF THE INVENTION

Microwave and millimeter-wave coaxial connectors are extensively employed to interconnect various components of a communications system with coaxial cable. These components are typically carried on a printed wiring board that is housed in a metallic enclosure. Connections into, and out of, said enclosure are accomplished by shielded coaxial connections, such that there is a continuous boundary of metal around the entire microwave circuitry. The coaxial connectors are fastened to the wall of the metallic enclosure. A feed-through system is used to provide communication between the coaxial connector and the printed wiring board circuit housed in the metallic enclosure.

FIGS. 1 and 2 are simplified representations of a microwave printed wiring board in an enclosure 11 with coaxial connectors 12 in accordance with the prior art. The connector 12 is an SMA type, however other types of coaxial connectors such as N type or BNC are also possible. A printed wiring board 14 having strip-line leads 17 interconnecting various components is carried inside the enclosure 11. The standard practice is to solder the feed-through pin 18 to the printed wiring board strip-line lead 17.

There are several significant disadvantages to soldering a feed-through pin to the printed wiring board strip-line 17. The solder joint is rigid and brittle, thermal expansions and contractions over time leads to fatigue and eventual failure of the solder connection. Furthermore in order to remove the connector or printed wiring board for repair or replacement, the solder material needs to be removed, a process that can easily damage the printed wiring board. Both soldering and de-soldering are time consuming operations that require skilled labor.

OBJECTS AND SUMMARY OF THE INVENTION

It is an object of the present invention to provide a connector assembly for detachably connecting a coaxial connector to a printed wiring board circuit.

It is a further object of the present invention to provide a connector assembly which transitions from a coaxial line to a micro-strip configuration.

The foregoing and other objects of the invention are achieved by an assembly which includes a metallic housing to house a printed wiring board circuit having a micro-strip defined by a lead on one surface of the board and a ground plane on the other surface of the board. Said housing also includes a low-impedance, coaxial line section formed by an opening extending through one wall of the housing and a center conductor supported in said opening by a dielectric sleeve. A connector with a lead connected to said microstrip lead and a body with a central insulated socket spaced from a ground plane on the surface of said board forms a transmission line section. Said center conductor is slidably received in said socket, whereby the coaxial connector can be easily attached to connect the printed wiring board to the coaxial transmission line.

BRIEF DESCRIPTION OF THE DRAWINGS

Additional objects and features of the invention will be more readily apparent from the following detailed description and appended claims when taken in conjunction with the drawings, wherein:

DESCRIPTION OF PREFERRED EMBODIMENT

Figure 1:
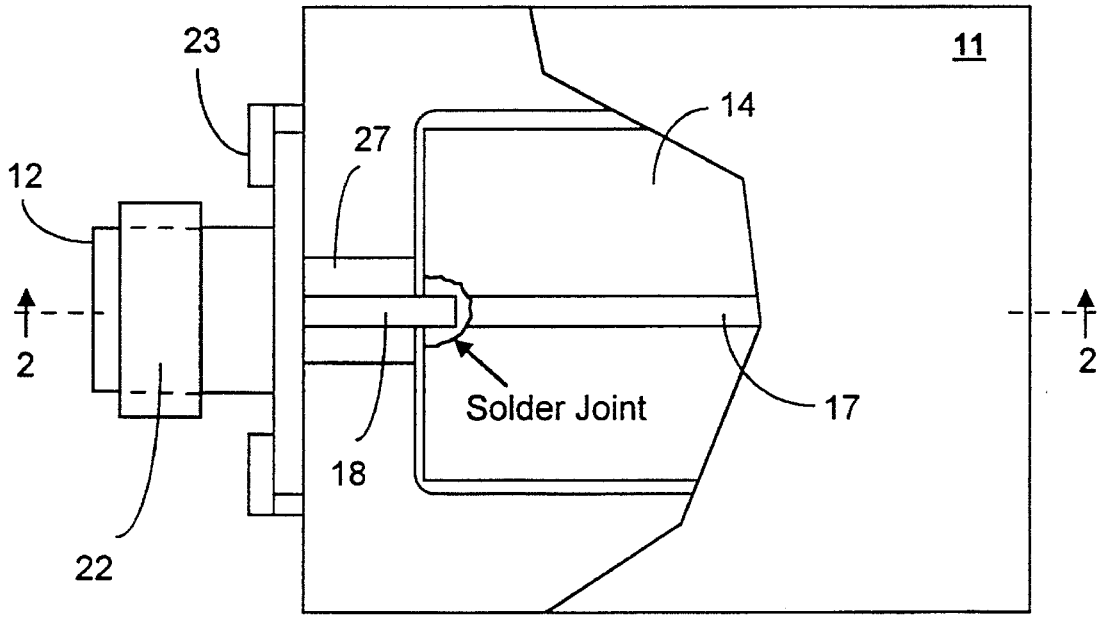
FIG. 1 PRIOR ART
FIG. 1 is a top plan view of a coaxial connector soldered to a printed wiring board micro-strip in accordance with the prior art.
Figure 2:
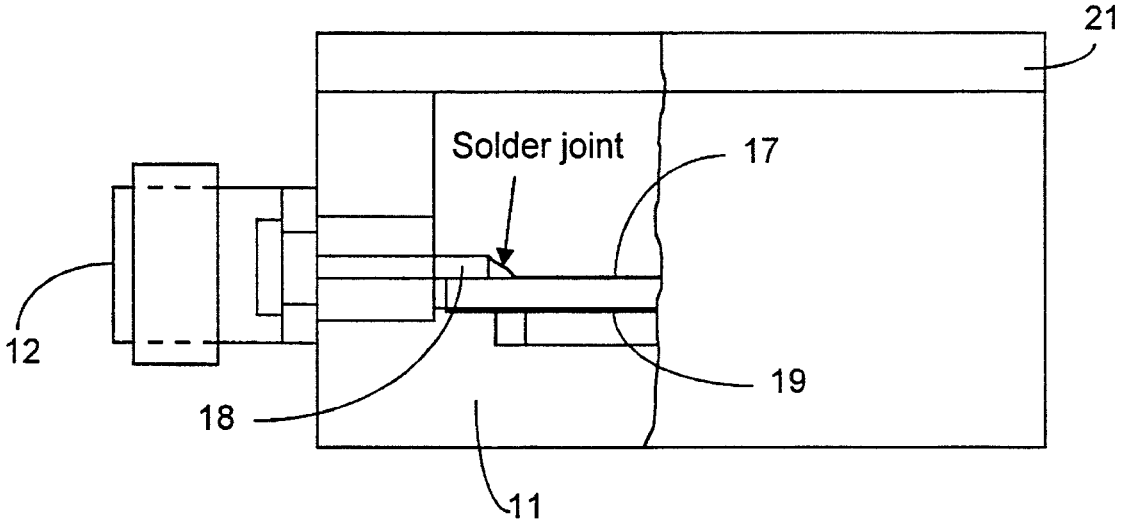
FIG. 2 PRIOR ART
FIG. 2 is a sectional view taken along the line 2—2 of FIG. 1.

Referring again to FIGS. 1 and 2 the printed wiring board circuit 1 is carried on the shelf 18 formed on the base of the enclosure 11. The printed wiring board includes a micro-strip transmission line defined by the conductor 17 and the conductive ground plane 19 formed on the lower surface of the printed wiring board. A cover 21 completes the housing on enclosure 11. The external section 22 of a conventional coaxial connector 12 is secured to the wall of the housing by screws 23. The center conductor or pin 18 of the connector extends through the aperture 27 formed in the wall of the housing and is soldered to the micro-strip lead 17. The impedance, generally 50 ohm, of the coaxial connector and that of the strip line are matched.

Figure 3:
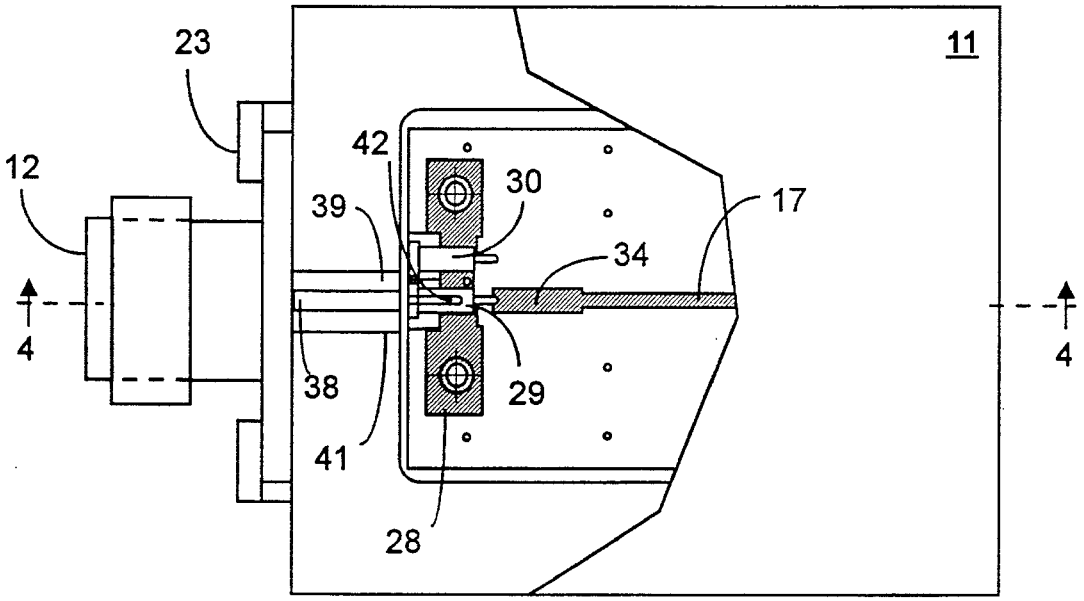
FIG. 3 is a top plan view of the preferred embodiment of the coaxial-to-printed wiring board transition of the invention.
Figure 4:
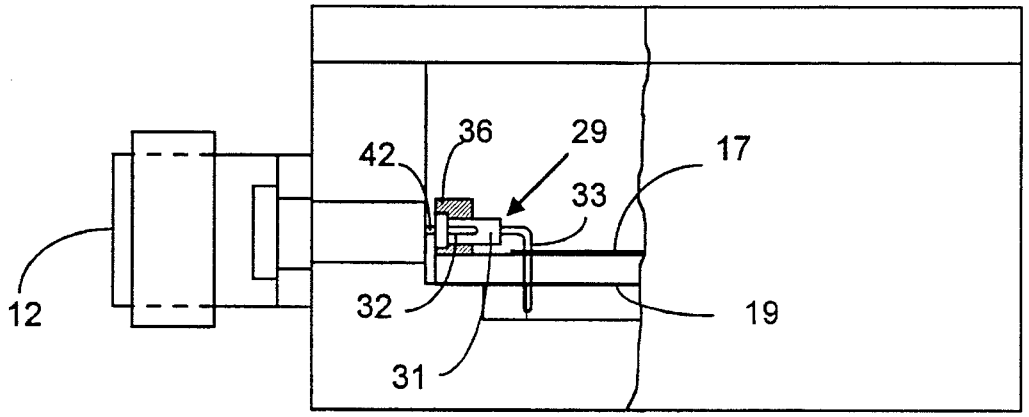
FIG. 4 is a sectional view taken along the line 4—4 of FIG. 3.

Referring now to FIGS. 3 and 4, a connector assembly in accordance with the invention is described where like reference numerals have been applied to like parts. The ground plane 19 of the printed wiring board is connected through vias to a ground plane section 28 formed on its upper surface. The connector 29 includes a metal body 31 having a socket 32 and a right angle pin 33 which is connected to the micro-strip lead 17. The lead 17 includes an enlarged section 34 which provides a matching impedance. The body 31 includes an insulating sleeve 36 which spaces the body from the ground plane section 28 to form a transmission line section. In the present embodiment, a second connector 30, identical to connector 29, is attached to and soldered with connector 29 to the printed wiring board to prevent the socket 29 from rotating during assembly. The center lead of the coaxial connector is connected to a coaxial transmission line section formed by the center conductor 38 supported by a dielectric sleeve 39 in the opening 41 formed in the housing. The dielectric sleeve diameter 38 is reduced to provide a lower impedance. A lead 42 extends outwardly from the center conductor 38 and is slidably received in the well 32.

The connector assembly of the invention provides operation over a wide frequency range up to 3.8 GHz. The wide frequency range of the present invention is accomplished by the small diameter of the insulating sleeve 36 of the connector and adding a low impedance matching section on the printed wiring board directly after the right angle header. These two elements in conjunction serve to tune out the highly inductive effect associated with the right angle header. Said inductance associated with the right angle header is minimized by bringing ground 28 up to the surface of the printed wiring board with a plurality of plated-through vias.

Figure 5:
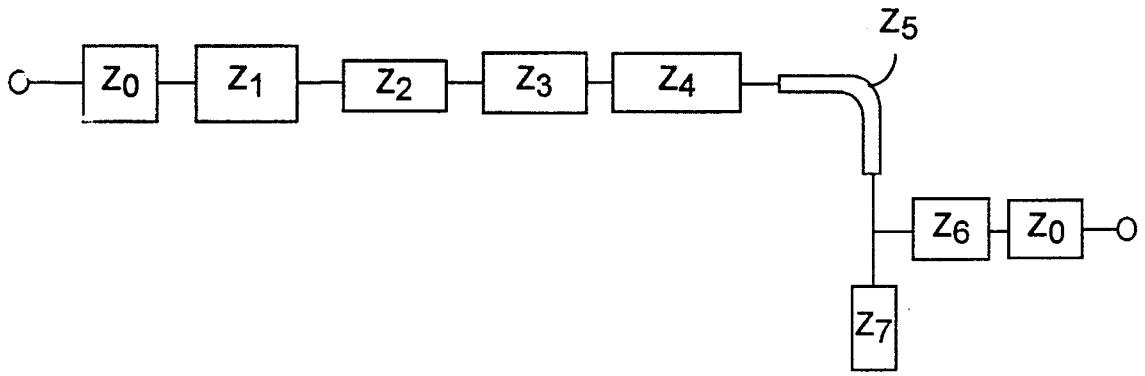
FIG. 5 is an equivalent electrical circuit of impedance characteristics of the transition from coaxial transmission line to printed wiring board of the invention.

Referring to FIG. 5 where the blocks represent impedance, $Z_0$ represents the impedance of the coaxial line, $Z_1$ the decreased impedance at the feed-through, $Z_2$ and $Z_3$ the impedance of the lead 42 with respect to the housing and with respect to the printed wiring board ground plane, $Z_4$ the header impedance, $Z_5$ the impedance of the right angle header, $Z_6$ the enlarged micro-strip section impedance, $Z_7$ the impedance between the bent header end and housing and $Z_0$ the same impedance as the input. Thus, the input coaxial impedance $Z_0$ matches the micro-strip impedance $Z_0$.

Thus there has been provided an interconnection assembly that allows field replaceable mounting of a printed circuit wiring board circuit in a metallic housing.

What is claimed:

1. A connector assembly for detachably connecting a printed wiring board circuit to a coaxial connector comprising:

a first socket mounted on said printed wiring board for slidably receiving the center lead of said coaxial connector, said center lead connected to a coaxial transmission line, a right angle pin extending from said first socket, a strip transmission line lead carried on the surface of said printed wiring board connected to said pin, a ground plane section on said surface of said printed wiring board, and an insulating sleeve surrounding said first socket whereby said first socket forms a transmission line section with said ground plane.

2. A connector assembly for detachably connecting a printed wiring board housed in a housing to a coaxial connector, said connector assembly comprising said coaxial connector secured to one wall of said housing, an impedance matching coaxial transmission line section formed by a center conductor supported by a dielectric sleeve in an aperture formed in said housing, said printed wiring board including a first socket to slidably receive said center conductor, a right angle pin extending from said first socket, a strip transmission line lead carried on the surface of said printed wiring board connected to said header, a ground plane section on said surface of said printed wiring board, and an insulating sleeve surrounding said first socket whereby said first socket forms a transmission line section with said ground plane.

3. A connector assembly as in claim 1 including a second socket connected to said first socket and secured to said printed wiring board for preventing rotation of said first socket.

4. A connector assembly as in claim 2 wherein said first socket, right angle pin, strip transmission line, ground plane section and insulating sleeve are configured to match the impedance of said coaxial connector and said coaxial transmission line section.

* * * * *

UNITED STATES PATENT AND TRADEMARK OFFICE

CERTIFICATE OF CORRECTION

PATENT NO. : 5,613,859

DATED : March 25, 1997

INVENTOR(S) : Bellantoni et al.

It is certified that error appears in the above-indentified patent and that said Letters Patent is hereby corrected as shown below:

Column 2, line 31, delete the numeral "1";

same line, delete the numeral "18".

Signed and Sealed this

Second Day of December, 1997

*Attest:*

Bruce Lehman

BRUCE LEHMAN

*Attesting Officer*

*Commissioner of Patents and Trademarks*